US010663267B2

(12) United States Patent
Leroux et al.

(10) Patent No.: US 10,663,267 B2
(45) Date of Patent: May 26, 2020

(54) OPTO-PYROTECHNIC ACTUATOR

(71) Applicant: ARIANEGROUP SAS, Paris (FR)

(72) Inventors: Paul Leroux, Civrac en Medoc (FR); Guillaume Demezon, Bordeaux (FR); Antoine Hervio, Saint Aubin en Medoc (FR); Jean-Michel Larrieu, Macau (FR)

(73) Assignee: ARIANEGROUP SAS, Paris (FR)

( * ) Notice: Subject to any disclaimer, the term of this patent is extended or adjusted under 35 U.S.C. 154(b) by 0 days.

(21) Appl. No.: 15/998,928

(22) PCT Filed: Feb. 14, 2017

(86) PCT No.: PCT/FR2017/050332
§ 371 (c)(1),
(2) Date: Aug. 17, 2018

(87) PCT Pub. No.: WO2017/140978
PCT Pub. Date: Aug. 24, 2017

(65) Prior Publication Data

US 2019/0339048 A1 Nov. 7, 2019

(30) Foreign Application Priority Data

Feb. 18, 2016 (FR) ..... 16 51339

(51) Int. Cl.
*F42B 3/113* (2006.01)
*F42B 3/195* (2006.01)

(52) U.S. Cl.
CPC ..... *F42B 3/113* (2013.01); *F42B 3/195* (2013.01)

(58) Field of Classification Search
CPC ..... F42B 3/113
(Continued)

(56) References Cited

U.S. PATENT DOCUMENTS 5,337,387 A * 8/1994 Kramer ..... G02B 6/3801 156/380.8
5,658,364 A * 8/1997 DeVore ..... G02B 6/3855 65/43
5,664,040 A * 9/1997 Kramer ..... G02B 6/4248 385/123

FOREIGN PATENT DOCUMENTS

EP 2 799 919 A1 11/2014
FR 2 693 559 A1 1/1994
(Continued)

OTHER PUBLICATIONS

International Search Report as issued in International Patent Application No. PCT/FR2017/050332, dated Jun. 9, 2017.
(Continued)

*Primary Examiner* — Reginald S Tillman, Jr.
(74) *Attorney, Agent, or Firm* — Pillsbury Winthrop Shaw Pittman LLP

(57) ABSTRACT

A method of fabricating an opto-pyrotechnic initiator, includes a) forming a body having a cavity in which a pyrotechnic charge is to be received, the body also having an internal passage extending between the cavity containing the pyrotechnic charge and an inlet opening out in an outside face of the body; b) placing a first portion of an optical fiber in the internal passage of the body, with a second portion of the optical fiber extending beyond the inlet of the body, and a glass preform being interposed between the optical fiber and the inlet of the body; and c) applying heat treatment to the glass preform to raise the glass preform to a temperature higher than the melting point of the glass preform so as to form a hermetic sealing element made of glass between the optical fiber and the inlet of the body.

11 Claims, 3 Drawing Sheets

(58) Field of Classification Search
USPC ..... 102/201
See application file for complete search history.

(56) References Cited

FOREIGN PATENT DOCUMENTS

| | | | | |
|---|---|---|---|---|
| FR | 2914056 B1 * | 3/2010 | ..... | F42B 3/113 |
| FR | 3 006 433 A1 | 12/2014 | | |

OTHER PUBLICATIONS

International Preliminary Report on Patentability and the Written Opinion of the International Searching Authority as issued in International Patent Application No. PCT/FR2017/050332, dated Aug. 21, 2018.

* cited by examiner

OPTO-PYROTECHNIC ACTUATOR

CROSS-REFERENCE TO RELATED APPLICATIONS

This application is the U.S. National Stage of PCT/FR2017/050332 filed Feb. 14, 2017, which in turn claims priority to French patent application number 1651339 filed Feb. 18, 2016. The content of these applications are incorporated herein by reference in their entireties.

BACKGROUND OF THE INVENTION

The invention relates to the field of pyrotechnic initiators that are ignited or primed by means of a light energy signal. This type of initiator is referred to as an opto-pyrotechnic initiator. The invention relates particularly, but not exclusively, to applications in space launchers where opto-pyrotechnic initiators are used for performing numerous pyrotechnic functions.

In known manner, an opto-pyrotechnic initiator comprises a pyrotechnic charge arranged in a cavity, an optical fiber connected at a first end to a source of light radiation, e.g. a laser diode, with the other end of the optical fiber being placed in the proximity of the pyrotechnic charge in order to transmit the light radiation thereto and ignite it.

The connection between the optical fiber and the body of the initiator is generally made by sticking the fiber in a ferrule with a gasket or directly to the body. That type of connection presents several drawbacks, in particular when the initiator is to be exposed to high temperatures and pressures. In particular, a connection between an optical fiber and an initiator body made by means of an adhesive possesses a lifetime that is limited because of organic substances that are present in the connection degassing so that the connection degrades over time. In addition, the mechanical and/or thermal strength of that type of connection is not guaranteed under temperature conditions of several hundreds of degrees Celsius and pressures of several hundreds of megapascals. Furthermore, that type of connection is complex and onerous to implement, in particular because of the need to use several different elements (ferrule, gaskets) in order to make the connection.

There thus exists a need for an opto-pyrotechnic initiator that is suitable for withstanding severe temperature and pressure conditions and for operating in those conditions, and to do so with lifetimes that are long, while also being suitable for being fabricated industrially.

OBJECT AND SUMMARY OF THE INVENTION

To this end, the present invention provides a method of fabricating an opto-pyrotechnic initiator, the method comprising the following steps:

a) forming a body having a cavity in which a pyrotechnic charge is to be received, the body also having an internal passage extending between the cavity containing the pyrotechnic charge and an inlet opening out in an outside face of said body;

b) placing a first portion of an optical fiber in the internal passage of the body, with a second portion of the optical fiber extending beyond the inlet of the body, and a glass preform being interposed between the optical fiber and the inlet of the body; and c) applying heat treatment to the preform to raise it to a temperature higher than the melting point of said glass preform so as to form a hermetic sealing element made of glass between the optical fiber and the inlet of the body.

The method of the invention for fabricating an opto-pyrotechnic initiator is advantageous in particular in that it enables a connection to be made between the optical fiber and the body of the initiator by sealing with glass. Specifically, the optical fiber is sealed to the body of the initiator by a glass hermetic sealing element that provides good adhesion both with the body of the initiator and with the optical fiber, and consequently provides good sealing. Such a sealing element is suitable for withstanding temperatures of more than 2700° C. for durations that are very short (a few milliseconds), and temperatures of about 200° C. over durations that are longer (several minutes), and of withstanding pressures of several hundreds of megapascals (MPa), corresponding to the conditions of use that are to be encountered in space launchers.

The connection between the optical fiber and the body of the initiator when made in accordance with the method of the invention does not have any organic substances, unlike prior art connections which make use of elastomer gaskets and of a large quantity of adhesion in order to provide structural strength. The connection of the invention is also chemically compatible with the optical fiber. It also makes it possible to reduce the number of parts needed for making a leaktight connection while being inexpensive to make and easy to industrialize.

Advantageously, the glass preform presents a melting temperature lying in the range 320° C. to 350° C., which makes it possible to preserve the integrity of the fiber.

According to a particular characteristic of the method of the invention, during step c), the glass preform is heated to reach a peak temperature lying in the range 320° C. to 420° C., the duration of heating, once the peak temperature has been reached, lying in the range 1 second (s) to 15 s.

Advantageously, the method of the invention further comprises a step of eliminating an organic coating present around the optical fiber on the first portion of said fiber. This makes it possible to increase the power of adhesion between the sealing element and the optical fiber while avoiding degassing from the surface of the fiber during the heat treatment.

The body of the initiator may be made of a refractory ceramic material or of a metal material.

Advantageously, the glass preform is made by pressing a glass powder and sintering the powder in a determined shape. Sintering does not leave any residue in the preform as formed in this way such that when the glass is remelted, there is no degassing.

Also advantageously, the glass preform is annular in shape, which makes it easier to interpose it between the optical fiber and the inlet of the body of the initiator.

The present invention also provides an opto-pyrotechnic initiator comprising a body having a cavity in which a pyrotechnic charge is received, the body also having an internal passage extending between the cavity containing the pyrotechnic charge and an inlet opening out in an outside face of said body, an optical fiber having a first portion present in the internal passage of the body and a second portion present outside the body, the optical fiber being for conveying a light signal suitable for initiating the pyrotechnic charge, the initiator also comprising a glass sealing element present between the inlet of the body and the optical fiber, the sealing element adhering both to the wall of the inlet of the body and to the outside surface of the optical fiber.

BRIEF DESCRIPTION OF THE DRAWINGS

The invention can be better understood on reading the following description made by way of non-limiting indication with reference to the accompanying drawings, in which.

DETAILED DESCRIPTION OF EMBODIMENTS

Figure 1:
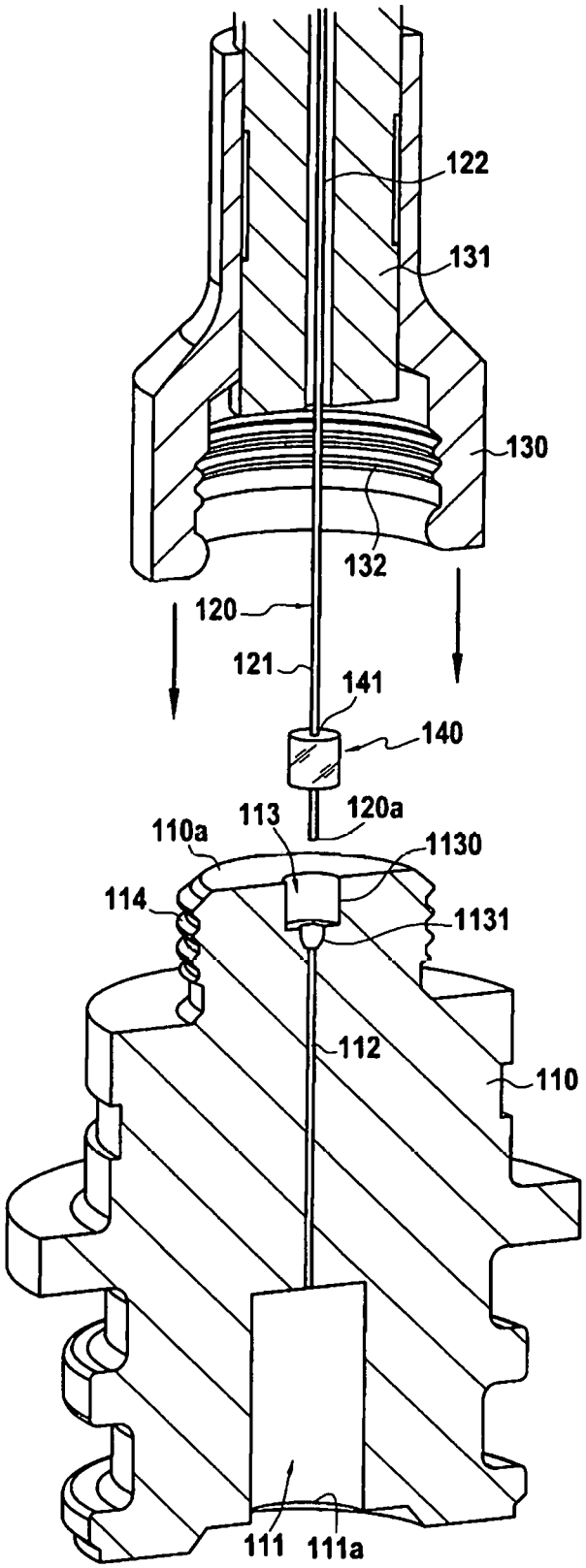
FIGS. 1 and 2 are diagrammatic section views showing the fabrication of an opto-pyrotechnic initiator in accordance with an embodiment of the invention.

FIGS. 1 to 4 show the fabrication of an opto-pyrotechnic initiator in accordance with an implementation of the invention. As shown in FIG. 1, the method begins by forming a body 110 having a cavity 111 that is to receive a pyrotechnic composition or charge. The cavity 111 has an opening 111*a* situated in the bottom portion of the body 110, the opening 111*a* corresponding to the portion of the body 110 through which the gas generated by the pyrotechnic charge is discharged. The body 110 also has an internal passage 112 extending between the cavity 111 and an inlet 113 leading to the top outside face 110*a* of the body 110. In this example, the inlet 113 has a cavity 1130 presenting a section (diameter) greater than that of the internal passage 112, the cavity 1130 being connected to the internal passage 112 via a neck 1131 presenting a section that decreases going from the cavity 1130 to the internal passage 112. The body 110 may be made of a metal material such as Inconel, 316 L or 17-4 PH stainless steel, or out of a refractory ceramic material, such as for example alumina, aluminum nitride, or boron nitride.

Figure 4:
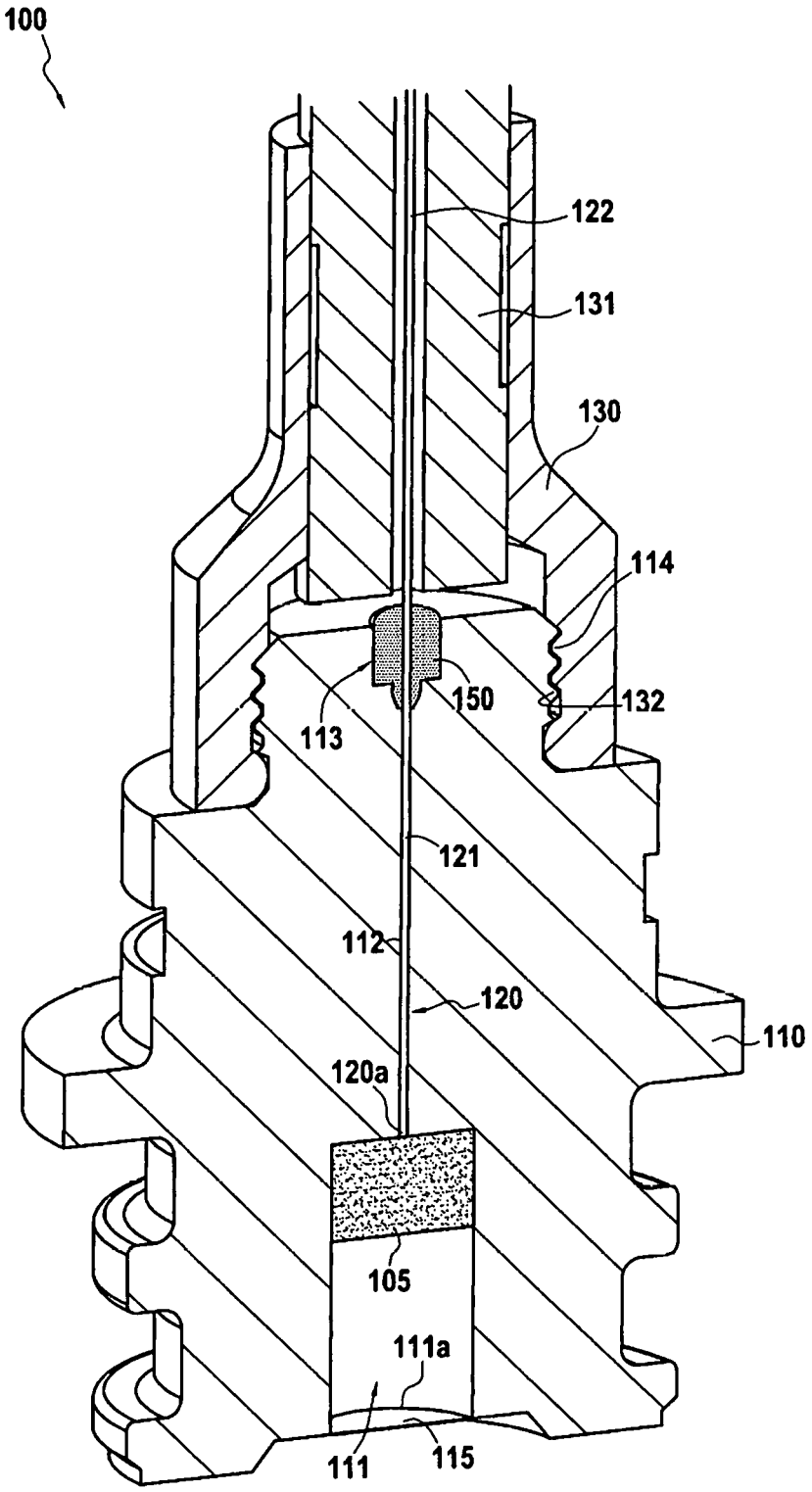
FIG. 4 is a diagrammatic perspective view of an opto-pyrotechnic initiator in accordance with an embodiment of the invention.

Fabrication of the nptn-pyrntenhnic initiator continues by placing an optical fiber 120 in the body 110. More precisely, the optical fiber 120 has a first portion 121 that is to be placed in the internal passage 112 so that the end 120*a* of the optical fiber 120 is positioned close to and facing a pyrotechnic charge 105 (FIG. 4). The optical fiber 120 has a second portion 122 that extends beyond the inlet 113 of the body 11U. The second portion 122 is supported in an endpiece 130 comprising a sheath 131 for protecting the optical fiber 120. In this example, the endpiece 130 presents tapping 132 for co-nperating with a thread 114 present on the body 110 so as to facilitate connecting the endpiece 130 to the body 110. The end of the optical fiber 120 (not shown in the figure) remote from the end 120*a* is for connecting to a source of light energy, such as for example a laser diode.

The first portion 121 of the optical fiber 120 is stripped prior to being placed in the internal passage 112. This step may include eliminating the protective sheath that might be present around the fiber and eliminating the organic coating present on the outside surface of the fiber in order to enhance adhesion with the glass of the preform while it is melting.

When the first portion 121 of the optical fiber 120 is placed in the internal passage 112, a glass preform 140 is interposed between the optical fiber and the inlet 113 of the body 110. For this purpose, the preform 140 is annular in shape, the optical fiber 120 being received in the central opening 141 of the preform 140. In the presently-described example, the preform 140 presents a diameter that is smaller than the diameter of the cavity 1130 of the inlet 113 so as to be capable of being placed therein, as shown in FIG. 2.

The preform 140 may be formed in particular by pressing glass powder into shape and sintering the powder to have a determined shape, such as an annular shape, for example. Sintering presents the advantage of not leaving any residue such that, on remelting, there is no degassing, thereby making it possible to achieve a connection that is entirely leaktight.

Figure 2:
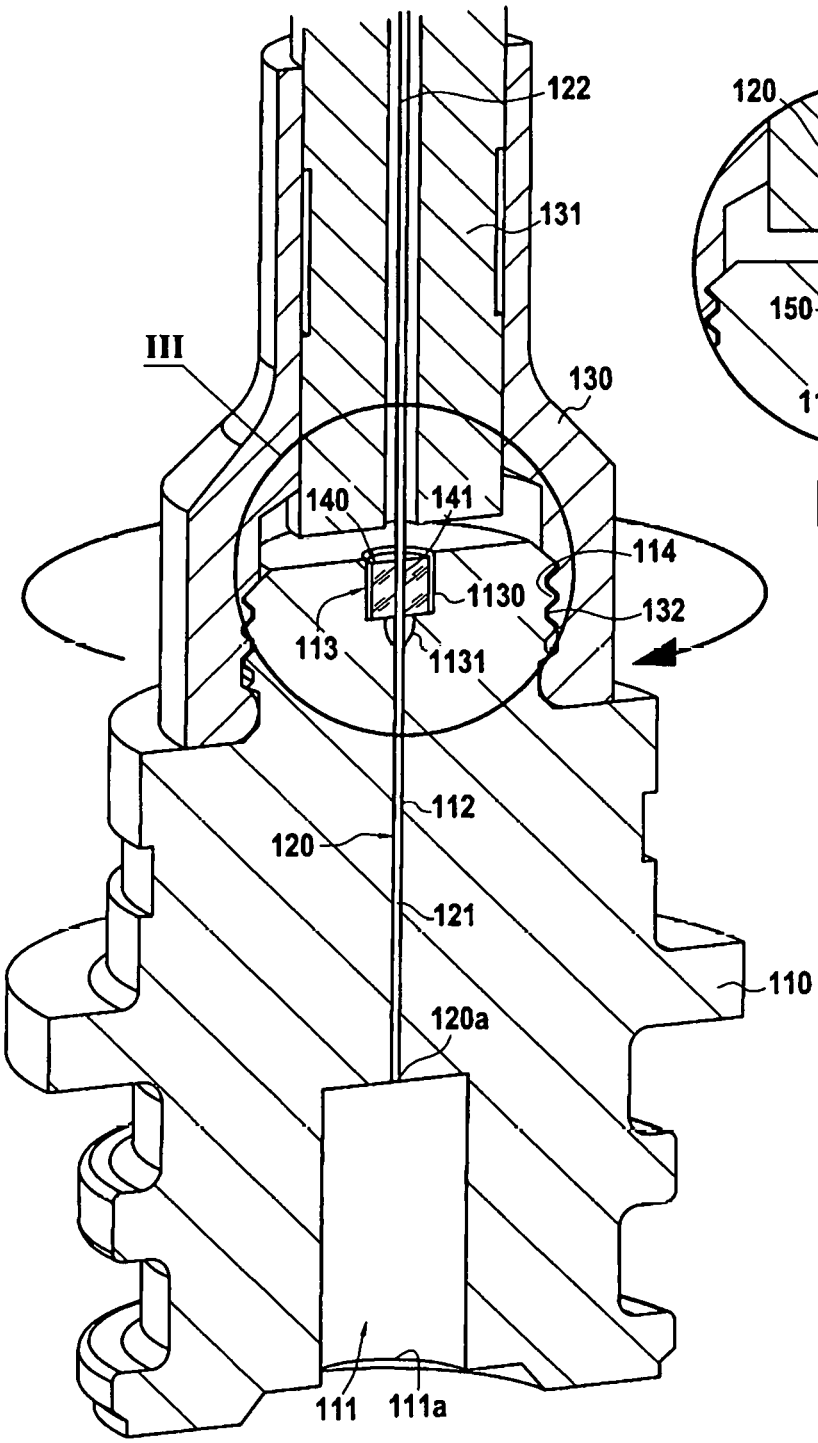

Once the endpiece 130 has been connected to the body 100 as shown in FIG. 2, the first portion 121 of the optical fiber 120 is positioned in the internal passage 112, while the glass preform 140 is present in the cavity 1130 of the inlet 113 of the body 110.

The preform 140 is then subjected to heat treatment at a temperature higher than its melting point so as to form a hermetic sealing element 150 between the optical fiber 120 and the inlet 113 of the body 110 (FIG. 4). The glass preform 140 is made from a glassmaking composition presenting a melting point lower than that of the optical fiber in order to avoid exposing the optical fiber to temperatures that are too high and might damage it. For this purpose, a glass composition is used that is doped with one or more elements serving to lower the melting point of the composition to a temperature lower than the melting temperature of the optical fiber. The glass composition used for forming the preform may in particular be a glass composition that is doped with lead, with phosphate, or with bismuth. The glass preform 140 thus preferably presents a melting point or temperature lying in the range 320° C. to 350° C., which temperatures are significantly lower than the melting temperatures of most optical fibers. The heating of the preform to melting preferably takes place locally in the body 110, i.e. in the zone containing the preform, with temperature rising rapidly to a peak temperature that is determined as a function of the melting point of the preform 140. The peak temperature preferably lies in the range 320° C. to 420° C. and it is preferably maintained for a duration lying in the range 1 s to 15 s. The preform may in particular be melted using any of the following heater means: electric heating; infrared radiation; induction heating; hot air; a laser; and heating by conduction.

Figure 3:
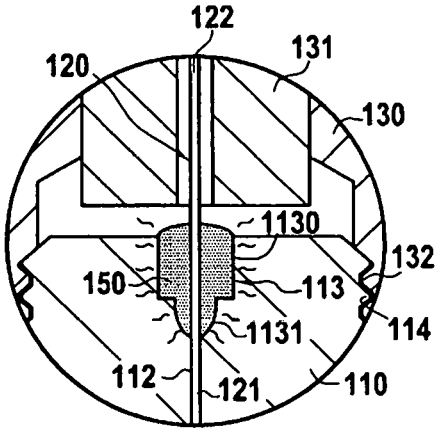
FIG. 3 is a detail view of FIG. 2 showing melting of a glass preform.

FIG. 3 shows the preform 140 melting. As can be seen in FIG. 3, the molten glass preform spreads in the cavity 1130 and also in the neck 1131, thereby increasing the area of adhesion with the optical fiber while also allowing the glass to expand with minimum stress. Once the preform has been melted, heating is stopped so as to allow the glass to cool and harden.

A pyrotechnic charge 105 is then placed, e.g. by compacting, in the cavity 111, which is subsequently optionally rinsed with a capsule 115. As shown in FIG. 4, this produces an opto-pyrotechnic initiator 100 comprising a body 110 with a cavity 111 that receives a pyrotechnic charge 105, the body 110 also having an internal passage 112 extending between the cavity 111 and an inlet 113 opening out into an outside face of said body. The initiator 100 also has an optical fiber 120 with a first portion 121 present in the internal passage 112 of the body 110 and a second portion 122 present outside the body 110, the end 120*a* of the optical fiber facing the pyrotechnic charge 105 as closely as possible, or even being in contact therewith. In accordance with the invention, the opto-pyrotechnic initiator 100 also has a hermetic sealing element 150 made of glass present between the inlet 113 of the body 110 and the optical fiber 120, the sealing element 150 adhering both to the wall of the inlet 113 and to the outside surface of the optical fiber 120.

The optical fiber 120 is for conveying a light signal suitable for initiating the pyrotechnic charge 105. In known manner, the opto-pyrotechnic initiator of the invention may be used to form a pyrotechnic chain, the body of the initiator then forming the first stage of the chain, the other stages of the pyrotechnic chain comprising pyrotechnic charges that are less and less sensitive and more and more energetic than the charge of the initiator.

The opto-pyrotechnic initiator of the invention is for use in environments that are severe, in particular in terms of pressure and temperature. Specifically, the opto-pyrotechnic initiator of the invention needs to be capable of withstanding both thermal flashes of several milliseconds duration at temperatures higher than 2700° C., and also temperatures of about 200° C. for a duration of several minutes. It must also be capable of withstanding dynamic pressures of several hundreds of megapascals (MPa). The opto-pyrotechnic initiator of the invention is suitable for withstanding such conditions of use, in particular because of the connection between the optical fiber and the initiator body, which is constituted by a hermetic sealing element made of glass. Specifically, since the sealing element is made of glass, it adheres well both with the body of the initiator, whether it is made of metal or ceramic material, and also with the optical fiber itself, which is made of glass.

The invention claimed is:

1. A method of fabricating an opto-pyrotechnic initiator, the method comprising the following steps:

a) forming a body having a cavity configured to receive a pyrotechnic charge, the body also having an internal passage extending between the cavity configured to receive the pyrotechnic charge and an inlet opening out in an outside face of said body;

b) placing a first portion of an optical fiber in the internal passage of the body, with a second portion of the optical fiber extending beyond the inlet of the body, and a glass preform being interposed between the optical fiber and the inlet of the body; and c) applying heat treatment to the glass preform to raise the glass preform to a temperature higher than the melting point of said glass preform so as to form a hermetic sealing element made of glass between the optical fiber and the inlet of the body, wherein the inlet also includes a cavity that has a section greater than a section of the internal passage, the hermetic sealing element made of glass being present in the cavity of the inlet.

2. A method according to claim 1, wherein the glass preform presents a melting temperature lower than the melting temperature of the optical fiber.

3. A method according to claim 2, wherein the glass preform presents a melting temperature lying in the range 320° C. to 350° C.

4. A method according to claim 2, wherein, during step c), the glass preform is heated to reach a peak temperature lying in the range 320° C. to 420° C., a duration of heating, once the peak temperature has been reached, lying in the range 1 s to 15 s.

5. A method according to claim 1, further comprising a step of eliminating an organic coating present around the optical fiber on the first portion of said optical fiber.

6. A method according to claim 1, wherein the body is made of a refractory ceramic material or of a metal material.

7. A method according to claim 1, wherein the glass preform is made by pressing a glass powder and sintering the powder in a determined shape.

8. A method according to claim 7, wherein the glass preform is annular in shape.

9. An opto-pyrotechnic initiator comprising a body having a cavity in which a pyrotechnic charge is received, the body also having an internal passage extending between the cavity containing the pyrotechnic charge and an inlet opening out in an outside face of said body, an optical fiber having a first portion present in the internal passage of the body and a second portion present outside the body, the optical fiber being for conveying a light signal suitable for initiating the pyrotechnic charge, the initiator also comprising a glass sealing element present between the inlet of the body and the optical fiber, the sealing element adhering both to a wall of the inlet of the body and to the outside surface of the optical fiber, wherein the inlet also includes a cavity that has a section greater than a section of the internal passage, the glass sealing element being present in the cavity of the inlet.

10. An initiator according to claim 9, wherein the body is made of refractory ceramic material or of metal material.

11. A method according to claim 1, further comprising, after step c), positioning the pyrotechnic charge in the cavity configured to receive the pyrotechnic charge.

* * * * *